US010405090B2

(12) United States Patent
Cross et al.

(10) Patent No.: US 10,405,090 B2
(45) **Date of Patent: *Sep. 3, 2019**

(54) WATER RESISTANT LOUDSPEAKER

(71) Applicant: Mitek Corp., Inc., Phoenix, AZ (US)

(72) Inventors: Alan Robert Cross, Monroe, WI (US); Chad A. Kautz, Lena, IL (US); Brad Michael Diedrich, Oregon, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/920,735

(22) Filed: Mar. 14, 2018

(65) Prior Publication Data

US 2018/0206030 A1 Jul. 19, 2018

Related U.S. Application Data

(63) Continuation-in-part of application No. 15/392,936, filed on Dec. 28, 2016.

(51) Int. Cl.

| | |
|---|---|
| ***H04R 1/44*** | (2006.01) |
| ***H04R 1/24*** | (2006.01) |
| ***H04R 1/28*** | (2006.01) |
| ***H04R 9/02*** | (2006.01) |
| ***H04R 9/06*** | (2006.01) |
| ***H04R 9/04*** | (2006.01) |

(52) U.S. Cl.

CPC ..... *H04R 1/44* (2013.01); *H04R 1/24* (2013.01); *H04R 1/2819* (2013.01); *H04R 1/2834* (2013.01); *H04R 9/025* (2013.01); *H04R 9/043* (2013.01); *H04R 9/06* (2013.01)

(58) Field of Classification Search

CPC ..... H04R 1/44; H04R 1/24; H04R 1/2819; H04R 1/2834; H04R 1/283; H04R 9/025; H04R 9/06; H04R 1/2842; H04R 1/2849; H04R 1/2857; H04R 1/2865; H04R 1/2873; H04R 1/288; H04R 1/2896; H04R 7/127

See application file for complete search history.

(56) References Cited

U.S. PATENT DOCUMENTS 3,912,866 A * 10/1975 Fox ..... H04R 1/2865 181/155
4,138,594 A * 2/1979 Klipsch ..... H04R 3/14 181/147
4,313,032 A * 1/1982 Thomas ..... H04R 1/30 181/152

(Continued)

*Primary Examiner* — Fan S Tsang
*Assistant Examiner* — Angelica M McKinney
(74) *Attorney, Agent, or Firm* — Keith L. Jenkins, Registered Patent Attorney, LLC; Keith L. Jenkins

(57) ABSTRACT

A water resistant speaker having a water-impermeable spider and an acoustic chamber in air flow communication with the underside of the spider via vents in a spider support and in a bottom panel of a basket of the speaker. The acoustic chamber is attached and sealed to the bottom of the basket. At least one hydrophobic vent is supported in the wall of the acoustic chamber or in the basket behind the spider to limit air pressure in the acoustic chamber. The acoustic chamber may have a passive radiator. The combination of a water impermeable spider and diaphragm, adjacently attached and sealed to the former, assist in preventing water from reaching the magnet assembly and voice coil. A vent in the pole piece, leading to the acoustic chamber, reduces drag on motion of the former, dust cap, and diaphragm.

20 Claims, 7 Drawing Sheets

(56) References Cited

U.S. PATENT DOCUMENTS

| | | | | | |
|---|---|---|---|---|---|
| 4,965,837 | A * | 10/1990 | Murayama | H04R 1/023 | 181/144 |
| 5,734,734 | A * | 3/1998 | Proni | H04R 9/02 | 381/400 |
| 5,909,015 | A * | 6/1999 | Yamamoto | H04R 9/022 | 181/156 |
| 6,343,134 | B1 * | 1/2002 | Czerwinski | H04R 1/26 | 381/182 |
| 6,626,262 | B1 * | 9/2003 | Chen | H04R 9/043 | 181/149 |
| 6,771,791 | B2 * | 8/2004 | Shelley | H04R 9/022 | 381/397 |
| 2003/0015369 | A1 * | 1/2003 | Sahyoun | H04R 1/2834 | 181/157 |
| 2005/0276438 | A1 * | 12/2005 | Kobayashi | H04R 1/24 | 381/433 |
| 2012/0128190 | A1 * | 5/2012 | Tam | H04R 1/283 | 381/346 |
| 2014/0029782 | A1 * | 1/2014 | Rayner | H04R 1/2834 | 381/386 |
| 2016/0219370 | A1 * | 7/2016 | Moro | H04R 9/022 | |
| 2016/0366499 | A1 * | 12/2016 | McGarry | H04R 1/023 | |

* cited by examiner

WATER RESISTANT LOUDSPEAKER

RELATIONSHIP TO OTHER APPLICATIONS

This application is a continuation in part of U.S. patent application Ser. No. 15/392,936 filed 28 Dec. 2016 to the same inventor.

FIELD OF ART

The present invention relates to a water resistant loudspeaker having a low-mid range frequency driver and a tweeter.

BACKGROUND OF THE INVENTION

Several attempts have been made to develop water resistant loudspeakers, sometimes referred to as waterproof loudspeakers. Porosity of the spider of a prior art speaker, combined with the necessity to provide cooling air vents in the basket, has led to limited success, as the water entering the air vents penetrates spider and reaches the voice coil, magnetic gap, former, and magnetic assembly, with unsatisfactory results. Merely making the spider impermeable to water creates an air spring behind the spider that degrades low frequency performance.

Accordingly, what is needed is a speaker that is both resistant to water and that has good low frequency performance.

SUMMARY OF THE INVENTION

Briefly described, the invention includes is a loudspeaker that is both resistant to water and that has good low frequency performance.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

Figure 1:
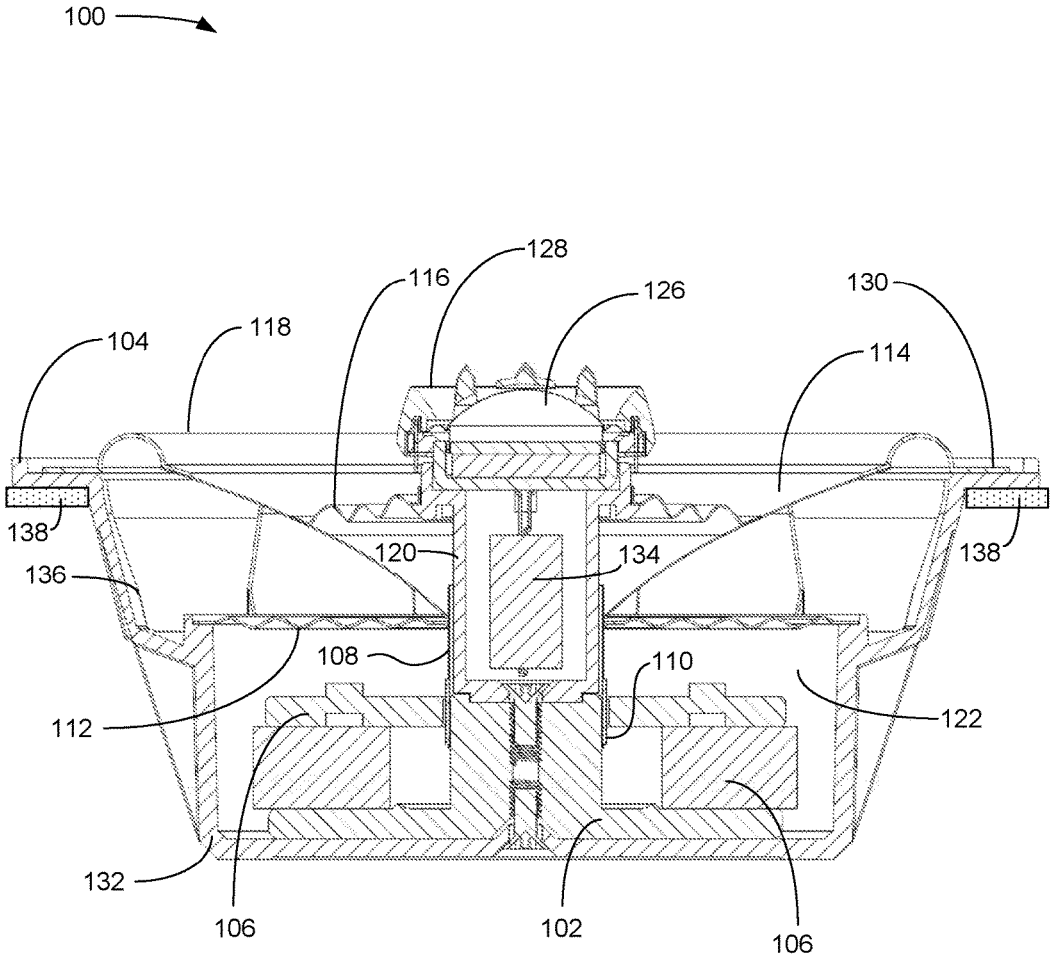
PRIOR ART FIG. 1
FIG. 1 is a cross sectional view illustrating an exemplary prior art water resistant speaker.

As used and defined herein, "upper", "lower", "top" and "bottom" are referenced to the drawing sheet, with the top of the drawing being "up". As used and defined herein, "rear", and "front", are referenced to a long central axis of the speaker, with the diaphragm end being "front" and the acoustic chamber end being "rear". As used and defined herein, "speaker" means "loudspeaker". It should be understood that the speakers of the present invention may be used in any orientation. As used and defined herein, "spider", a term of art, means an annular corrugated flexible device that attaches to a former to keep the former centered over the pole piece while the voice coil oscillates the former. As used and defined herein, "sealed" includes "made watertight".

FIG. 1 is a cross sectional view illustrating an exemplary prior art water resistant speaker 100. Water resistant speaker 100 has a basket 132 that has openings 136, making the speaker 100 water resistant only from the front, and only when mounted in a baffle 138. The basket 132 has a rim 104 to which surround flange 130 is sealed. Surround 118 is a water-impermeable material and makes a water-tight seal with diaphragm 114. Upper spider 116 is rubberized to make it water impermeable. Upper spider 116 is sealed to diaphragm 114 and to tweeter stem 120. Tweeter stem 120 supports hard-dome 126 tweeter 128, which is a sealed water tight unit. Capacitor 134 provides a high-pass filter to the tweeter 128. Former 108 supports voice coil 110 which oscillates within a magnetic gap formed by top plate 106 and a pole piece of yoke 102 under the magnetic field provided by the magnet 106. Former 108 is flexibly supported by lower spider 112, which is porous to water and air. Former 108 is sealed to diaphragm 114, making only the front of speaker 100 water tight. With this design, if the lower spider is made non porous to water, it becomes no-porous to air as well, making the airspace spring 122 behind the lower spider 112 so stiff that it raises the resonant frequency of the loudspeaker 100 which reduces the low frequency response. Merely making the lower spider 112 water impermeable is not a solution.

Figure 2:
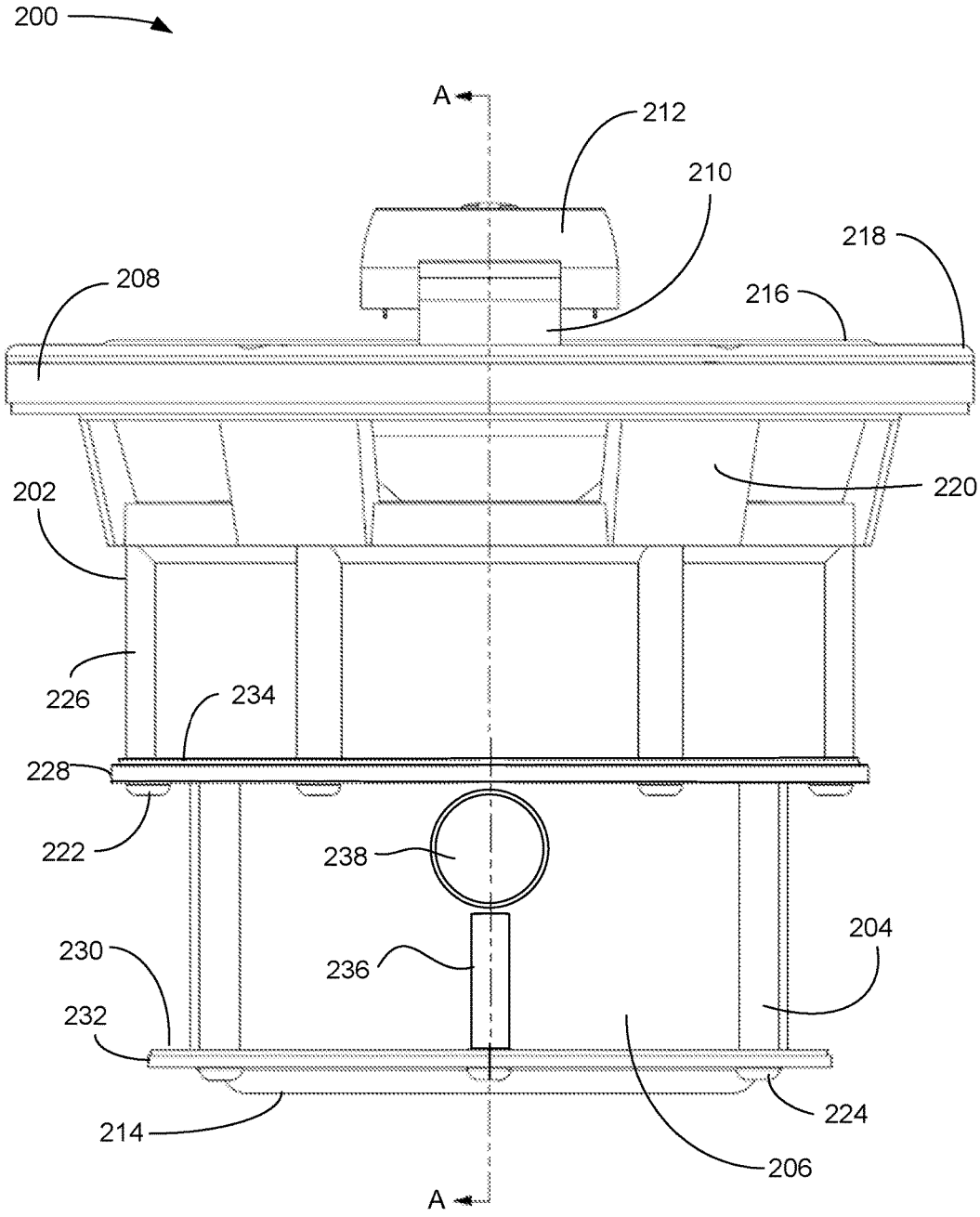
FIG. 2 is a front elevation view illustrating an exemplary first embodiment of a water resistant loudspeaker and defining across section AA, according to a preferred embodiment of the present invention.

FIG. 2 is a front elevation view illustrating an exemplary first embodiment of a water resistant loudspeaker 200 and defining across section AA, according to a preferred embodiment of the present invention. Water resistant loudspeaker 200 has a basket 202 including support pillars 220 (one of four visible labeled) and an annular top rim 208. An annular tweeter support 218 is supported by annular top rim 208 and supports cross bar 210 which, in turn, supports tweeter lens 212. Top rim 208 also supports upper surround 216. A rear acoustic chamber housing 206 supports a lower surround 214 that supports a passive diaphragm 306 (see FIG. 3). Cylinders 204 receive fasteners 224, to fasten an annular ring 232 and seal 230 to acoustic chamber housing 206 and the interior wall of cylinders 204. Hydrophobic vent 238 equalizes pressure between the rear acoustic chamber housing 206 and the external environment to prevent pressure build up in the rear acoustic chamber housing 206. Hydrophobic vent 238 may be, for non-limiting example, LOW PROFILE SNAP-FIT VENT—P515955 from Donaldson Company, Inc. of Minneapolis, Minn. The illustrated position of the hydrophobic vent 238 is not a limitation of the present invention. Surround 214 is attached to annular ring 232. Fasteners 222 (one of four visible labeled) are received in cylinders 226 (one of three visible labeled) and half cylinder 236 to fasten rear acoustic chamber housing 206 to basket 202 by fasteners 222 through outwardly radially extending flange 228 of the rear acoustic chamber housing 206 and annular seal 234.

Figure 3:
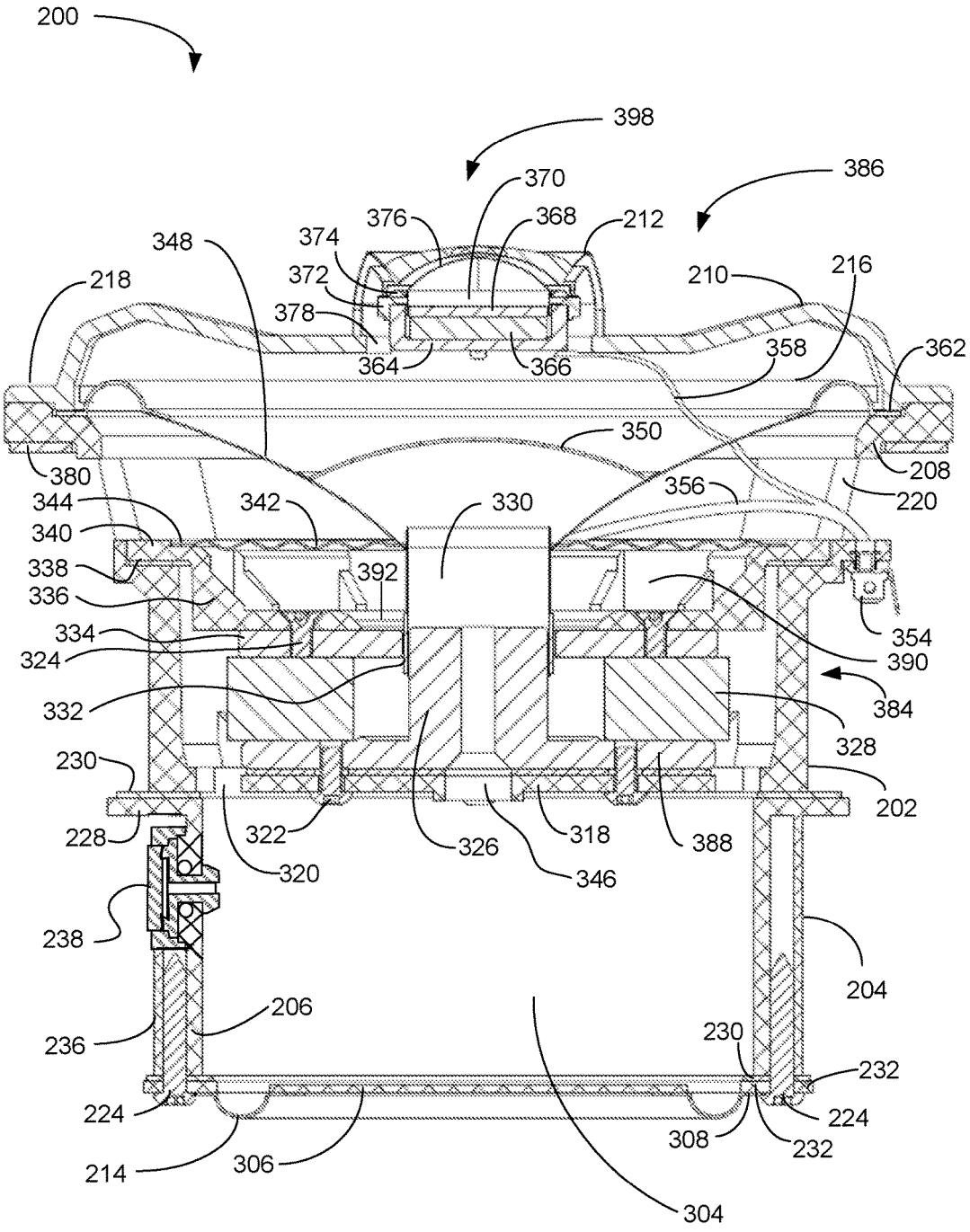
FIG. 3 is a cross sectional view through cross section AA illustrating the exemplary embodiment of the water resistant loudspeaker of FIG. 2, according to a preferred embodiment of the present invention.

FIG. 3 is a cross sectional view through cross section AA illustrating the exemplary embodiment of the water resistant loudspeaker 200 of FIG. 2, according to a preferred embodiment of the present invention. Water resistant loudspeaker 200 has three main parts: a driver 384, a tweeter assembly 386, and a rear acoustic chamber 304.

Driver 384 includes basket 202 which has a vented 320, 346 bottom panel 318 that is fastened 322 to and supports magnetically conductive yoke 388, including pole piece 326. Yoke 388 supports annular magnet 328, which supports top plate 334. Former 330 is coupled and sealed to water-impermeable diaphragm 348 and to water-impermeable spider 342, preferably at adjacent positions on the former, such that the former is not exposed to any water between the spider 342 and the diaphragm 348. Former 330 surrounds pole piece 326 and supports voice coil 332 in a magnetic gap between pole piece 326 and top plate 334. Top plate 334 supports and is fastened 324 (one of two visible labeled) to annular spider support 336. The inner radius of annular spider support 336 is significantly larger than the diameter of the former 330 and voice coil 332, leaving gap 392 to allow free motion of the former 330 and voice coil 332 in the magnetic gap. Annular spider support 336 is multiply vented 604 (see FIG. 6) allowing air flow past the outside of magnet 328 and through vents 320 in bottom plate 318. As a result, the air spring behind spider 342 is the size of the space in the driver behind the spider 342 plus the space in the rear acoustic chamber 304. In a particular embodiment, vents 604 (see FIG. 6) are aligned with vents 320. Preferably, there are six spider support vents 604 and six bottom panel vents 320. Pole piece vent 346 reduces drag on the combination of the former 330, the dust cap 350, and the diaphragm 348, thereby improving speaker performance.

Water-impermeable spider 342 is attached and sealed to a top flange 340 of spider support 336. Top spider support flange 340 is supported on a rubberized seal 338 on basket 202. Spaces between basket pillars 220 allow water into the area between the bottom of the diaphragm 348 and the water impermeable spider 342, but the water cannot get through the sealed, water-impermeable spider 342 nor the sealed, water-impermeable diaphragm 348, making the water-resistant speaker 200 impermeable to water from any direction. Diaphragm 348 is preferably made of polypropylene or a material with similar functional characteristics, including being water impermeable. Diaphragm 348 supports dust cap 350, which is also preferably made of polypropylene or a material with similar functional characteristics and is attached and sealed to diaphragm 348. Diaphragm 348 is supported, on its outer perimeter, by upper surround 216, which is preferably rubber or a similarly functioning material. A radially outer flange 362 of upper surround 216 is supported by top rim 208. Resilient deformable water-impermeable gasket 380 is supported underneath top rim 208.

Basket 202 supports audio signal electrical connector 354 that supplies lower frequency signals to the voice coil 322 via a water tight penetration through the spider 342. The high frequency audio signal line 358 penetrates the diaphragm 348 to supply audio signals to tweeter 398 and may be sealed. In a particular embodiment, the high frequency audio signal line 358 may be routed through crossbar 210.

Acoustic chamber 304 includes rear acoustic chamber housing 206 and a plurality of smaller vertical outer cylindrical walls 204 extending from rear acoustic chamber housing 206 to provide reception for fasteners 224. The top of rear acoustic chamber housing 206 includes an outwardly radially extending flange 228 supporting an annular seal 230. The top of acoustic chamber 304 is bounded by vented 320, 346 bottom panel of basket 324. The bottom of rear acoustic chamber 304 is closed off by a passive radiator including a lower surround 214 supporting passive diaphragm 306. A radially outer flange 308 of lower surround 214 is attached and sealed to annular ring 232, which is fastened within walls of the rear acoustic chamber housing 206 with a seal 230 between the annular ring 232 and rear acoustic chamber housing 206. Passive diaphragm 306 responds to air pressure differences in the acoustic chamber 304 to improve performance of water resistant loudspeaker 200. Rear acoustic chamber housing 206 supports a hydrophobic vent 238, as shown. In a particular embodiment, hydrophobic vent 238 may be positioned on basket 202. Any position behind the spider 342 and in basket 202 or rear acoustic chamber housing 206 is suitable for positioning one or more hydrophobic vents 238.

Tweeter assembly 386 includes tweeter 398, annular tweeter support 218 and cross bar 210, which connects tweeter 398 to annular tweeter support 218. Annular tweeter support 218 is supported by top rim 208 and clamps radially outer flange 362 of upper surround 216 against the top rim 208. Annular tweeter support 218, radially outer flange 362 of upper surround 216, and gasket 380 are preferably fastened together by suitable fasteners such as, for non-limiting examples, bolts or screws. Cross bar 210 extends from opposing portions of annular tweeter support 218. Tweeter 398 is supported by cross bar 210. Tweeter 398 includes water-impermeable U-yoke 364 supporting magnet 366 and tweeter dome mount 372 which, in turn, supports tweeter roll 374. Magnet 366 is preferably a neodymium magnet 366. Tweeter roll 374 supports hard tweeter dome 376. Front plate 368 is supported above magnet 366. An air chamber 370 is maintained between the front plate 368 and the tweeter dome 276. Annular space 378 receives a potting material to lock the tweeter 398 in place and ensure a watertight seal. Tweeter lens 212 includes a bar that is placed over the tweeter dome 376 to improve the high frequency response and avoid external contacts with the tweeter dome 376.

Figure 4:
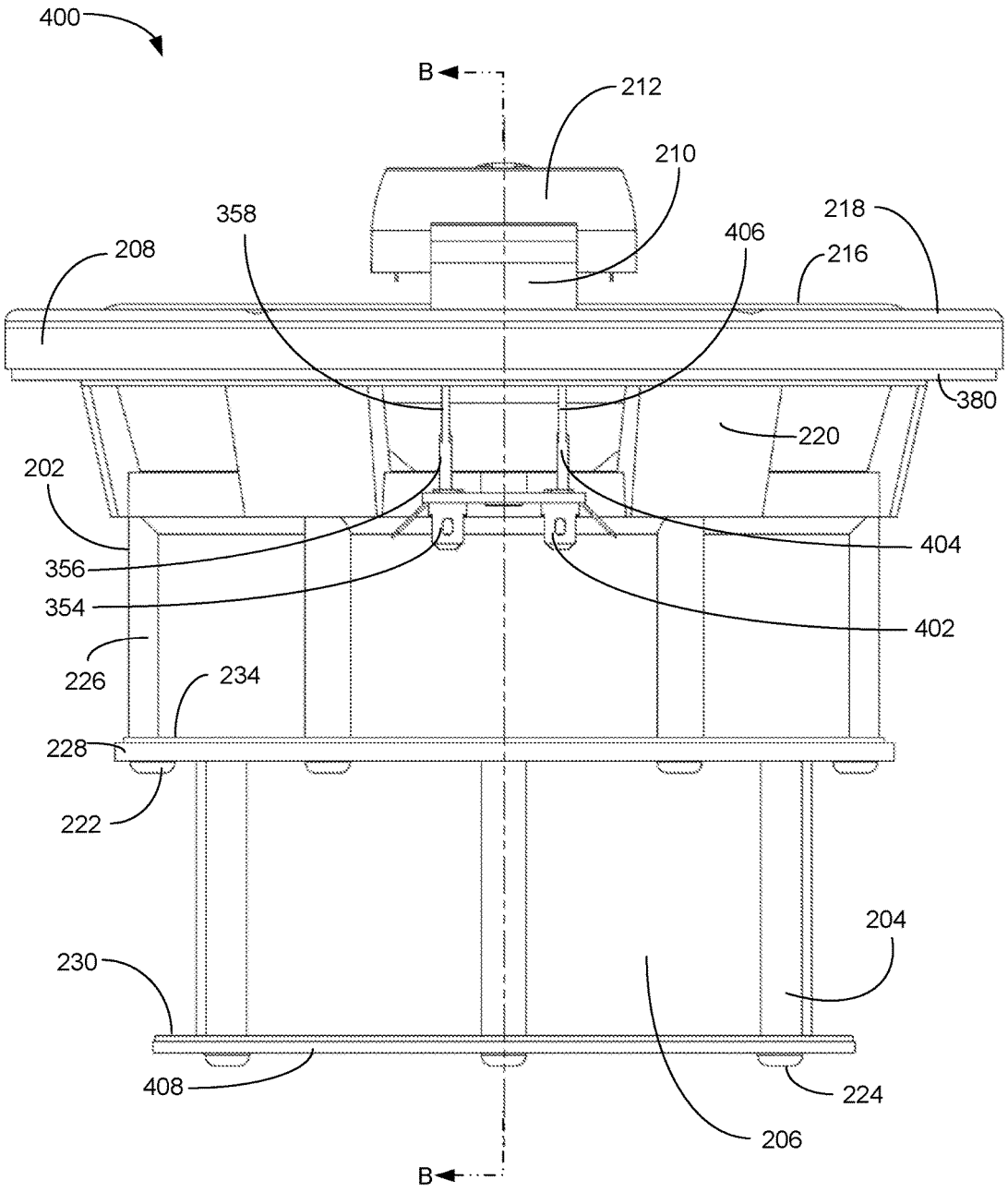
FIG. 4 is a rear elevation view illustrating an exemplary second embodiment of a water resistant loudspeaker and defining across section BB, according to a preferred embodiment of the present invention.

FIG. 4 is a rear elevation view illustrating an exemplary second embodiment of a water resistant loudspeaker 400 and defining across section BB, according to a preferred embodiment of the present invention. Acoustic chamber 204 has a flat panel 408 instead of the passive diaphragm 306 and surround 214. Audio signal connector 254 and audio signal lines 356 and 358 are readily visible in this view, as are audio signal connector 402 and audio signal lines 404 and 406, which complete the circuits through the voice coil 332 and the tweeter 398, respectively.

Figure 5:
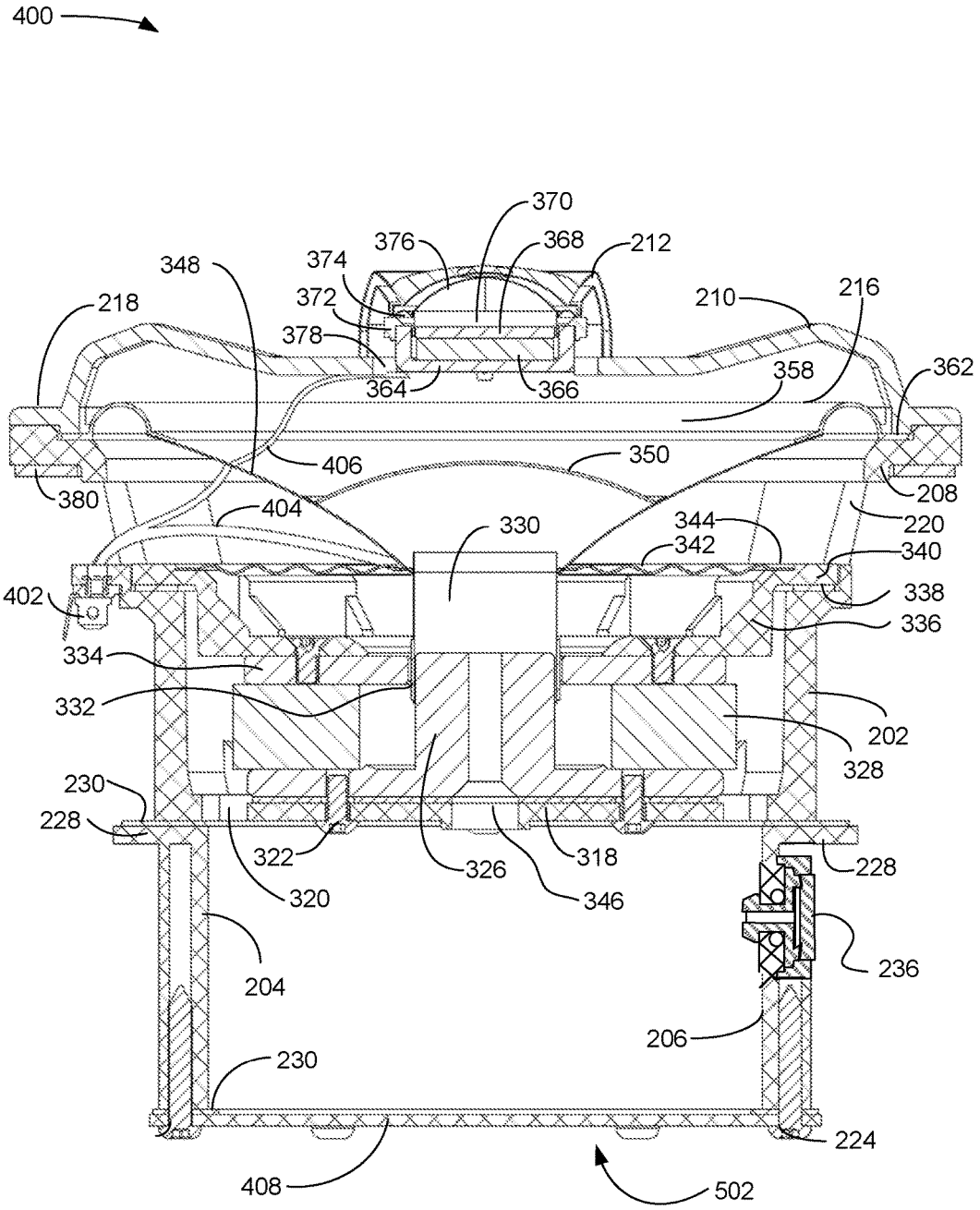
FIG. 5 is a cross sectional view through cross section BB illustrating the exemplary embodiment of the water resistant loudspeaker of FIG. 4, according to a preferred embodiment of the present invention.

FIG. 5 is a cross sectional view through cross section BB illustrating the exemplary embodiment of the water resistant loudspeaker 400 of FIG. 4, according to a preferred embodiment of the present invention. Rear acoustic chamber 502 differs from rear acoustic chamber 304 only in that flat panel 408 replaces the passive diaphragm 306 and surround 214 of water resistant loudspeaker 200. This embodiment provides a sufficiently large air spring behind the spider 342 to avoid loss of low frequency performance. Hydrophobic vent 236 limits the air pressure in rear acoustic chamber 502 while resisting the entrance of water.

Figure 6:
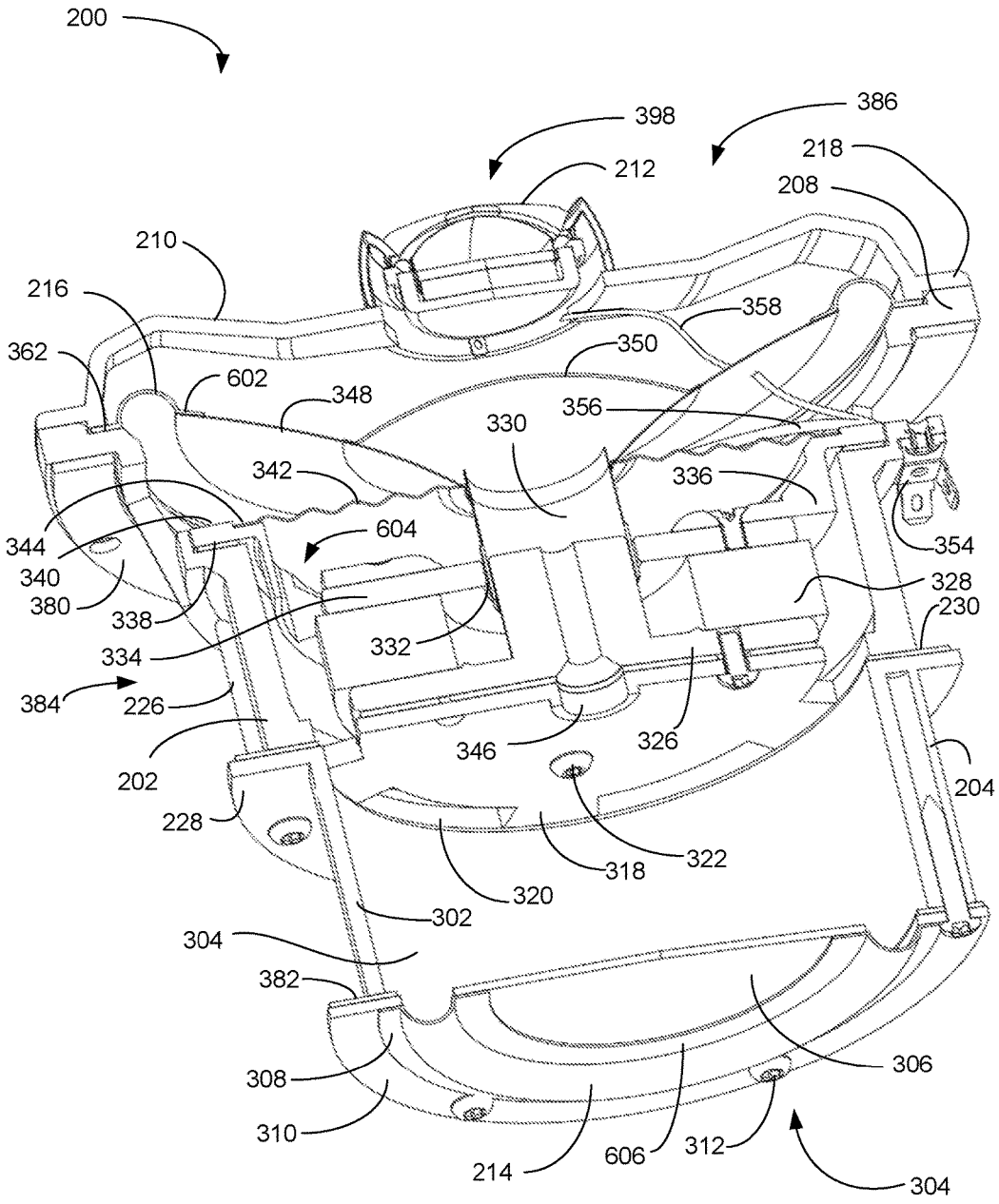
FIG. 6 is a cross sectional perspective view illustrating the exemplary embodiment of the water resistant loudspeaker of FIG. 2, according to a preferred embodiment of the present invention.

FIG. 6 is a cross sectional perspective view through cross section AA illustrating the exemplary embodiment of the water resistant loudspeaker 200 of FIG. 2, according to a preferred embodiment of the present invention. Vent 604 in the spider support 336 can be seen aligned to a vent 320 (one of two and two halves labeled) in the bottom 318 of basket 202. The inner flange 602 of the upper surround 216 is attached and sealed to the diaphragm 348. The inner flange 606 of the lower surround 214 attached and sealed to the diaphragm 306.

Figure 7:
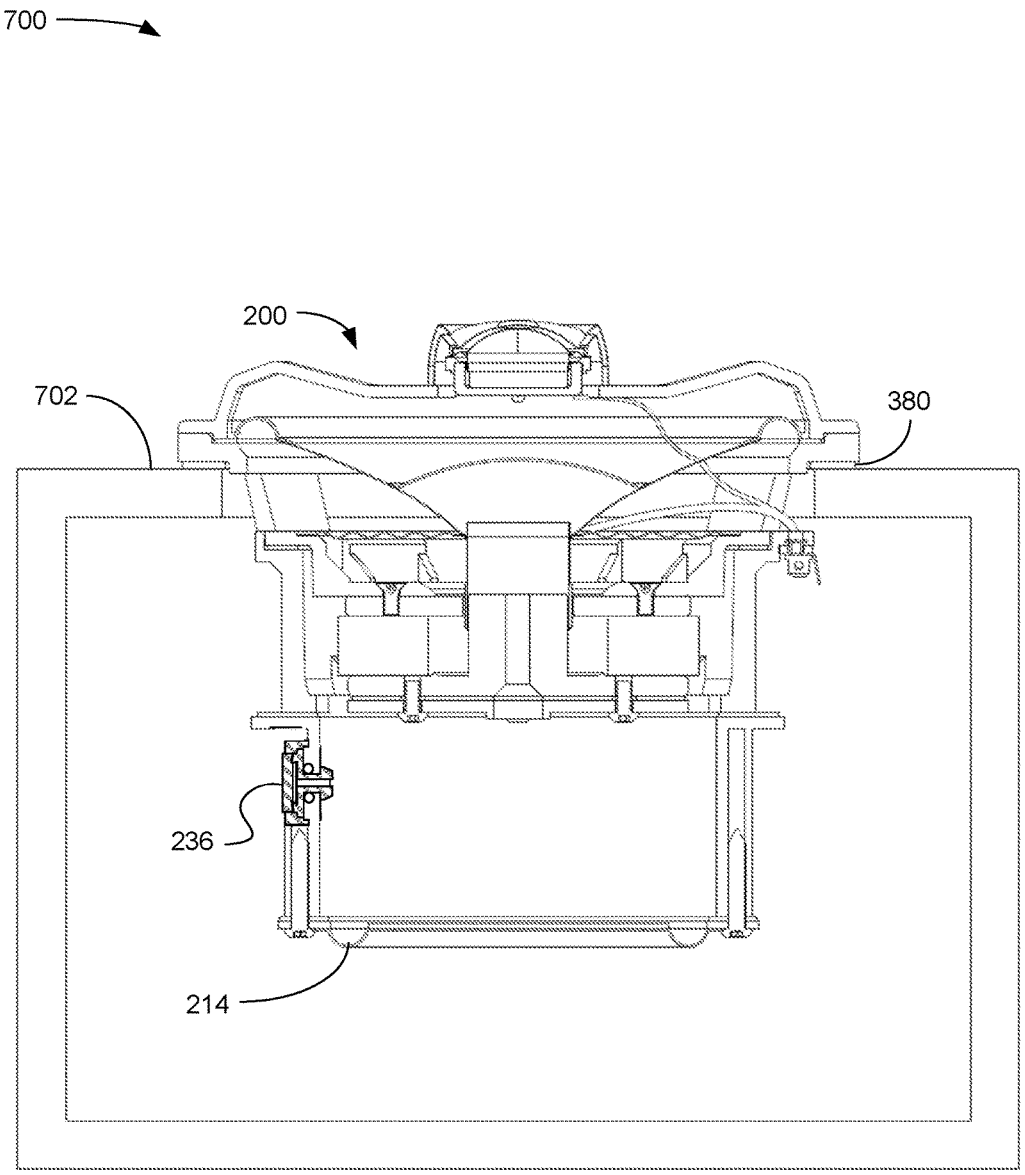
FIG. 7 is a cross sectional elevation view through cross section AA illustrating the exemplary embodiment of the water resistant loudspeaker of FIG. 2 installed in an enclosure, according to a preferred embodiment of the present invention.

FIG. 7 is a cross sectional elevation view through cross section AA illustrating the exemplary embodiment of the water resistant loudspeaker 200 of FIG. 2 installed in an enclosure 702, according to a preferred embodiment of the present invention. Resilient deformable gasket 380 seals water resistant loudspeaker 200 to the enclosure. The air sealed in the enclosure 702 damps the motion of passive diaphragm 306, thereby improving speaker performance. Hydrophobic vent 236 limits the air pressure in rear acoustic chamber 304.

We claim:

1. A water resistant loudspeaker comprising:
- a. a water-impermeable spider;
- b. a rear acoustic chamber behind said water-impermeable spider having a size adapted to maintain speaker performance at low frequencies; and
- c. at least one hydrophobic vent in at least one of:
  - i. a housing of said rear acoustic chamber; and
  - ii. a basket of said water resistant loudspeaker behind said water-impermeable spider;
- d. a water tight seal between an outer spider flange and a spider support.

2. The water resistant loudspeaker of claim 1, comprising a first water-impermeable attachment attached and sealed between an inner spider flange and a former.

3. The water resistant loudspeaker of claim 2, comprising a second water-impermeable attachment attach and sealed between a water-impermeable diaphragm and said former, wherein said first water-impermeable attachment is adjacent said second water-impermeable attachment.

4. The water resistant loudspeaker of claim 1, comprising:
- a. said basket having a bottom panel having at least one vent into said rear acoustic chamber; and
- b. said spider support directly supported by said basket, and having wherein said spider support has at least one vent into said rear acoustic chamber.

5. The water resistant loudspeaker of claim 4, wherein said at least one bottom panel vent is aligned to said at least one spider support vent.

6. The water resistant loudspeaker of claim 1, comprising an exclusively axial vent through a pole piece of a yoke of a magnetic assembly and into said rear acoustic chamber.

7. The water resistant loudspeaker of claim 1, comprising an acoustic chamber housing enclosing said rear acoustic chamber, wherein said acoustic chamber housing is attached and sealed to a bottom of said basket of said water resistant loudspeaker.

8. The water resistant loudspeaker of claim 7, comprising at least two vents providing fluidic communication between a volume adjacent to said water-impermeable spider and said acoustic chamber housing.

9. The water resistant loudspeaker of claim 7, comprising a passive radiator further comprising a surround attached and sealed to an annular ring that is fastened to a bottom edge of a wall of said acoustic chamber housing.

10. The water resistant loudspeaker of claim 1, comprising:
- a. a flat annular tweeter support attached and sealed to top rim of said basket of said water resistant loudspeaker;
- b. a cross bar extending from opposing portions of said annular tweeter support and across a surround and a diaphragm of said water resistant loudspeaker; and
- c. an outwardly projecting water-impermeable tweeter supported on said cross bar.

11. A water resistant loudspeaker comprising:
- a. a water-impermeable spider having a first water-impermeable attachment attached to a former;
- b. a water impermeable diaphragm having a second water-impermeable attachment attached to said former;
- c. wherein said first water-impermeable attachment is adjacent said second water-impermeable attachment;
- d. a rear acoustic chamber housing enclosing a rear acoustic chamber behind said water-impermeable spider having a size adapted to maintain speaker performance at low frequencies; and
- e. at least one hydrophobic vent in at least one of:
  - i. said rear acoustic chamber housing; and
  - ii. a basket of said water resistant loudspeaker behind said water-impermeable spider;
- f. a spider support supported by said basket and having at least one vent.

12. The water resistant loudspeaker of claim 11, wherein said basket comprises a bottom panel having at least one vent.

13. The water resistant loudspeaker of claim 12, wherein said at least one bottom panel vent is aligned to said at least one spider support vent.

14. The water resistant loudspeaker of claim 11, comprising an exclusively axial vent through a pole piece of a yoke of a magnetic assembly.

15. The water resistant loudspeaker of claim 11, comprising said rear acoustic chamber housing enclosing said rear acoustic chamber, wherein said rear acoustic chamber housing is attached and sealed to bottom of said basket of said water resistant loudspeaker.

16. The water resistant loudspeaker of claim 15, comprising at least two vents providing fluidic communication between a volume adjacent to said water-impermeable spider and said rear acoustic chamber.

17. The water resistant loudspeaker of claim 15, comprising a passive radiator further comprising a surround attached and sealed to an annular ring that is fastened to a bottom edge of a wall of said rear acoustic chamber housing.

18. A water resistant loudspeaker comprising:
- a. a water-impermeable spider having a first water-impermeable attachment attached to a former;
- b. a water impermeable diaphragm having a second water-impermeable attachment attached to said former;
- c. wherein said first water-impermeable attachment is adjacent said second water-impermeable attachment;
- d. an acoustic chamber housing enclosing a rear acoustic chamber attached and sealed to a basket of said water resistant loudspeaker behind said water-impermeable spider and having a size adapted to maintain speaker performance at low frequencies;
- e. at least one hydrophobic vent in at least one of:
  - i. said acoustic chamber housing; and
  - ii. said basket of said speaker water resistant loudspeaker behind said water-impermeable spiders; and
- f. a spider support supported by said basket, wherein said spider support comprises at least one vent.

19. The water resistant loudspeaker of claim 18, comprising:

a. said basket having a bottom panel having at least one vent;

b. wherein said at least one bottom panel vent is aligned to said at least one spider support vent;

c. an exclusively axial vent through a pole piece of a yoke of a magnetic assembly; and d. at least two vents providing fluidic communication between a volume adjacent to said water-impermeable spider and said acoustic chamber housing.

20. The water resistant loudspeaker of claim 18, comprising:

a. a flat annular tweeter support attached and sealed to top rim of said basket of said water resistant loudspeaker;

b. a cross bar extending from opposing portions of said annular tweeter support and across a surround and said water-impermeable diaphragm of said water resistant loudspeaker; and c. an outwardly-projecting water-impermeable tweeter supported on said cross bar.

* * * * *